United States Patent [19]

Pfaffmann et al.

[11] Patent Number: 4,675,057

[45] Date of Patent: Jun. 23, 1987

[54] METHOD OF HEAT TREATING USING EDDY CURRENT TEMPERATURE DETERMINATION

[75] Inventors: George D. Pfaffmann, Farmington; Donald E. Novorsky, Pleasant Ridge, both of Mich.

[73] Assignee: Tocco, Inc., Boaz, Ala.

[21] Appl. No.: 834,570

[22] Filed: Feb. 28, 1986

[51] Int. Cl.[4] ..... C21D 1/54

[52] U.S. Cl. ..... 148/129; 266/87; 266/90

[58] Field of Search ..... 148/128, 129, 150; 266/87, 90, 78; 374/183; 324/236, 233

[56] References Cited

U.S. PATENT DOCUMENTS 3,756,870 9/1973 Kasper et al. ..... 148/150
4,059,795 10/1980 Mordwinkin ..... 324/233
4,230,987 2/1979 Mordwinkin ..... 324/236
4,359,210 11/1982 Peterson ..... 266/87
4,427,463 1/1984 Spies ..... 148/129

FOREIGN PATENT DOCUMENTS 0014729 11/1985 European Pat. Off. .
0159806 10/1985 Japan ..... 266/87

*Primary Examiner*—L. Dewayne Rutledge
*Assistant Examiner*—S. Kastler
*Attorney, Agent, or Firm*—Body, Vickers & Daniels

[57] ABSTRACT

A method and apparatus for the heat treating of quench hardenable ferrous alloy workpieces utilizing periodic eddy current excitation and reflection to determine the in-line cooling rate from the critical temperature of the workpiece material and comparing the in-line cooling rate against a standard rate for establishing acceptance or rejection of the quenched workpiece.

9 Claims, 4 Drawing Figures

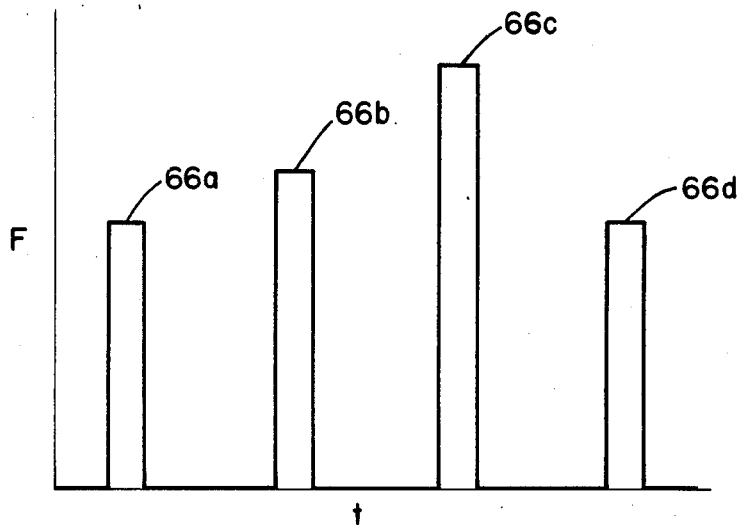
FIG. 3
FIG. 4
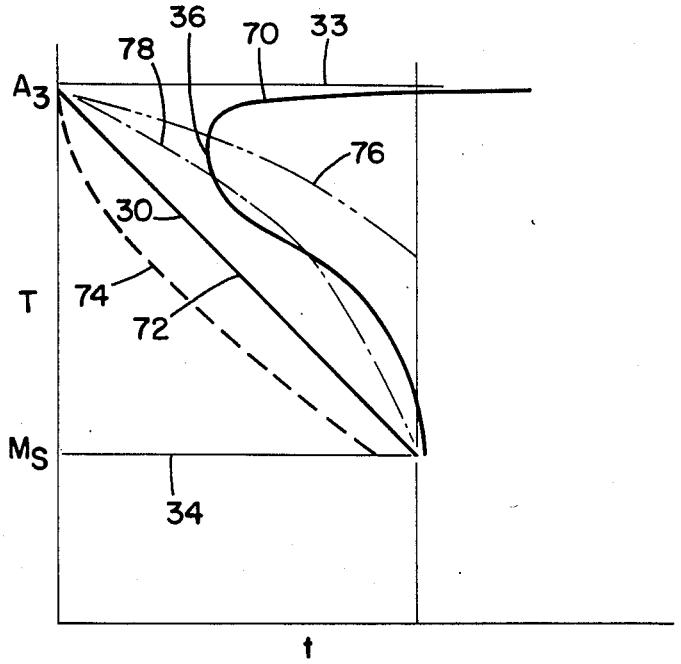

METHOD OF HEAT TREATING USING EDDY CURRENT TEMPERATURE DETERMINATION

BACKGROUND

The present invention relates to the art of heat treating and, in particular, to the controlled cooling of electrically conductive metals to achieve particular metallurgical characteristics.

The present invention has particular utility in the quench hardening of ferrous materials and will be described with reference thereto: however, it will become appreciated that the invention has broader aspects in ascertaining metallurgical cooling rates for other materials wherein the cooling rate affects the metallurgical characteristics of the heat treated parts.

Induction heating followed by liquid media quenching is a widely used technique for increasing the hardness of ferrous alloy parts. Such increased hardness may be provided as a surface treatment, for instance the journal area on a shaft, or to a substantial depth for parts experiencing high torsional, tensile and/or compressive loads. In all these cases, the requisite hardness is achieved by inductively heating the part to an elevated temperature above the critical temperature to provide an austenitic structure to at least the desired hardness depth. The heating is followed by a quenching period wherein the austenitic structure is transformed into a martensitic structure without formation of other transformation structures. In order to avoid the undesired transformation products, an adequate cooling rate is necessary, prescribed in a well known manner by the time-temperature-transformation (T-T-T) diagram for the particular alloys. Although critical to part acceptability, the cooling or quenching rate has not been a monitored in-line process parameter. Rather, adequate hardness has been determined through post-process destructive or non-destructive off-line testing and then for only a statistically selected number. Thus, the test does not provide current information for individually determining hardness, but rather provides an indication of the quality control for the tested sample lot. To increase the frequency of sampling has heretofore been deemed prohibitively expensive and time consuming.

BRIEF SUMMARY OF THE INVENTION

The present invention provides a method of determining the quenching rate for quench hardened parts in an in-line process and on the basis thereof determining acceptance/ rejection of the hardened part. This is generally achieved by monitoring the reflected response to periodic eddy current coil excitation during the quenching cycle. More particularly, the total reflected response, or the resistive and/or magnetic components thereof, is correlated to a temperature range, at a selected depth, for the part being hardened. Thus the coil response or output will be indicative of the temperature at the selected depth. Eddy current excitation is applied periodically during the cooling cycle and the response gathered during an extended reflection period. The measurement thus obtained provides the basis for ascertaining the temperature versus time experienced during the cycle. These results are compared to a model curve of temperature versus time and based on test rate of change or test temperature point in time, the processed part is catagorized accepted or rejected. This may be provided through visual display, printed matter, or microprocessing comparison. The result, however, provides an in-line cooling rate analysis by periodically applying eddy current excitation, comparing the reflected response to a model response profile to determine the acceptance or rejection of the processed part.

Accordingly, an object of the present invention is to provide a method and apparatus for determining the cooling rate for metal parts undergoing heat treatment to provide altered metallurgical properties.

Another object of the present invention is to provide a method of monitoring the cooling rate of quench-hardenable ferrous parts.

A further object of the present invention is to provide a method for in-line determination of part hardness.

Still another object of the present invention is to provide a method of cooling rate determination using eddy current coil response.

Yet another object of the present invention is to provide a method of cooling rate determination for quench hardened ferrous parts using periodic eddy current measurements correlated to temperature to determine the acceptance or rejection of the processed part.

BRIEF DESCRIPTION OF THE DRAWINGS

The above and other objects of the invention will become apparent upon reading the following description of the preferred embodiment taken in conjunction with the accompanying drawings in which:

FIG. 3 is a schematic diagram of the eddy current excitation: and,

FIG. 4 is a transformation diagram illustrating the effect of cooling rates on workpiece hardness.

DETAILED DESCRIPTION OF THE PREFERRED EMBODIMENT

Figure 1:
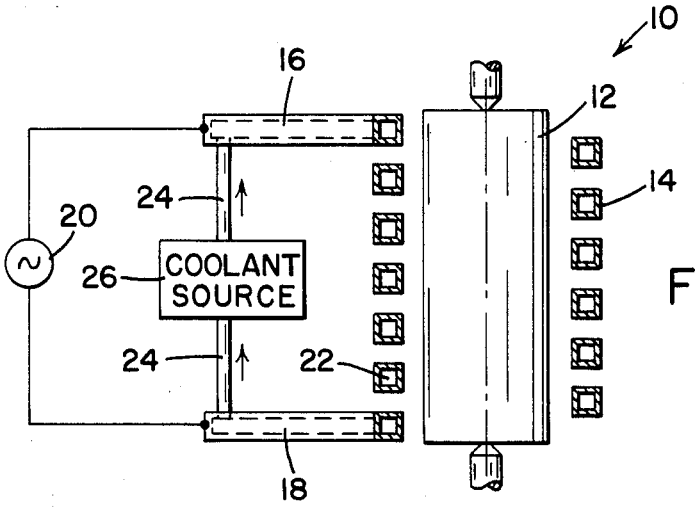
FIG. 1 is a side sectional and schematic view of the induction heating apparatus for heating a workpiece.

Referring to the drawings for the purpose of illustrating the preferred embodiment only and not for limiting same, FIG. 1 shows somewhat schematically an induction heating apparatus 10 for inductively heating an elongated cylindrical workpiece 12, formed of a hardenable ferrous material. The apparatus 10 generally comprises a multiple-turn induction coil 14 exteriorally surrounding the workpiece 12 in spaced relation thereto. The coil 14 is formed of, in a well known manner, rectangular electronically conductive material, such as copper. The coil 14 has leads 16, 18 connected to a conventional high frequency power supply 20 having suitable controls for regulating the frequency, power level, and duration of the induction heating. The coil 14 has an internal passage 22 fluidly connected by conduits 24 to a coolant source 26 for maintaining, in a well known manner, the operating temperature of the coil 14 within controlled limits. In operation, the coil 14 is energized by the power supply 20 to inductively heat the exterior of the workpiece 12 to an elevated austenitizing temperature based on the workpiece material.

The workpiece material is air or liquid cooled at a rate which will transform the austenite to martensite without transformation into other transformation products. It is thus necessary that the rate of cooling be sufficient to stay outside the transformation curve prescribed by the time-temperature-transformation curve for the workpiece material in the cooling from the $A_3$ critical temperature to the starting martensitic, or $M_S$, temperature. To a large extent the rate of cooling above and below these temperatures is not a factor in determining the hardness of the quenched article. However, within this range the rate of cooling is critical in determining the acceptability of the hardened parts. Thus, as shown in FIG. 4, a straight cooling rate, indicated by line 30, from the critical $A_3$ temperature 33 to the starting martensitic temperature $M_S$, 34 can be prescribed which will clear the nose 36 of the cooling curve. Parts cooled at a rate to the left of the line will be fully hardened whereas rates to the right will pass through the curve and produce non-acceptable, non-martensite, transformation products. Accordingly, it is important to be able to ascertain both temperature versus time, as well as rate of temperature change versus time.

Figure 2:
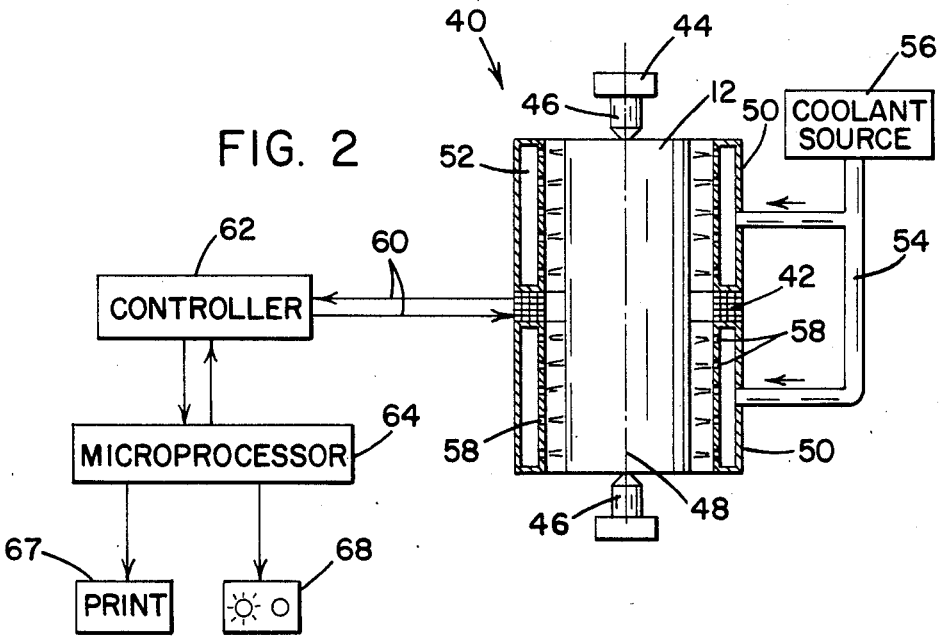
FIG. 2 is a side elevational and schematic view of the quenching and testing unit for the workpiece.

To this end, the workpiece 12 heated to above the critical temperature 33 is transferred to a quenching and testing unit 40, as shown in FIG. 2, by suitable manual or automatic equipment, not shown. The unit 40 comprises an eddy current coil 42 supported by a frame member 44 having centers 46 supporting the workpiece 12 about an axis 48. For materials requiring liquid quenching, a coolant or quenching ring 50 is provided encircling the workpiece 12 on either side of the coil 40. The quenching ring 50 has an internal passage 52 fluidly connected by conduit 54 to a suitably controlled coolant source 56. Coolant from the source 56 enters the passage 52 through conduit 52 and flows radially inwardly onto the workpiece through a plurality of radially directed ports 58. For air quenched materials, the coolant system may be deactivated or eliminated.

The eddy current coil 42 includes leads 60 electrically connected to a controller 62 which in turn is connected to a microprocessor 64. The controller 62 is effective in a well known manner to apply a high frequency current to the coil 42 which induces an eddy current in the workpiece 12. The coil 42 has an output section which detects the induced eddy current. The induced eddy current is fed back to the controller 62 and to the microprocessor 64. The frequency applied at each pulse is one having a known correlation to the temperature and depth of current penetration in the workpiece, i.e. surface measurement, or measurement of a particular depth. Thus as shown in FIG. 3, it is not necessary that only a single frequency be applied for a given workpiece design or that only a single temperature depth be detected. For instance, different frequencies 66*a*, 66*b*, 66*c* and 66*d* may be employed to a given design which have the best correlation for the temperature range to be detected at a selected point in the cooling curve. Additionally, the frequencies may be varied to sequentially detect temperature at different depths during the quenching cycle.

Preferably, as shown in FIG. 3, the frequency is applied to the coil 42 at regular intervals with a zero input period of sufficient length to detect the resonant current output. The output is translated by the microprocessor 64 into a temperature and a rate of change in temperature with respect to other periodic measurements and continues for the entire quenching cycle. The microprocessor 64 may be coupled to a printer 67 providing printed results for operator analysis or to an indicating device 68 visually indicating acceptance or rejection based on a comparison of the test measurements during the cooling from the critical temperature to the martensitic temperature with respect to programmed acceptable temperatures and rates of change during a comparable measurement period.

By way of example, as shown in FIG. 4, the T-T-T diagram for the rest workpiece has a critical cooling curve indicated by numeral 70. The microprocessor 64 is programmed for an acceptable cooling curve indicated by numeral 72 for incremental times. Three representative test outputs are indicated by the numerals 74, 76 and 78. For test 74 the output correlated temperatures are to the left of both the acceptable cooling curve 72 and the transformation curve 70. Such a workpiece would be indicated as acceptable based on end point analysis, point in time analysis, or rate of change analysis, and an appropriate acceptable command would be issued. Test curve 76 crosses the transformation curve 70 and continues through the transformation area at the end of the test period. Thus, the part would be rejected based on end point analysis, point in time analysis, particularly by intersection with the curve 70, and rate of change analysis over the initial period. The microprocessor 64 accordingly would issue a rejection command for the workpiece to the device 68. Test curve 78 makes a transient through the transformation curve 70 but ends in point of time substantially at the final point of the test curve 72. Accordingly, end point analysis of the output would indicate product acceptability. However, point time analysis and rate of change analysis would indicate rejection. Inasmuch as failure to satisfy only one of the test criteria would indicate insufficient hardening, rejection of the part would be indicated. Obviously the range of acceptability will vary from part to part and with the requirements for quality control. Moreover, it will be appreciated that the test frequencies and outputs at temperature will, of necessity, be empirically derived. Thus sample parts at various test point temperatures may be scanned at various frequencies to determine which frequency provides the most reliable measurement for a particular temperature range. Moreover, the frequency versus time scan may be compared against results for various parts to provide additional data for revising the comparison or enhancement of the program cycle. The end result, however, it that eddy current output can be utilized on a full time or statistical basis for indicating for in-line quenching cycles, acceptability or non-acceptability of the quenched hardened parts. Moreover, the test data may be used to initiate cooling rate revision through increased cooling rates, by increased coolant flow for liquid quenched parts or by momentary or low rate supplemental liquid cooling for air quenched parts.

Obviously, these and other modifications may be effective for the quench hardening of other parts based on design, metallurgical, economic and other like issues while realizing the benefits of the in-line eddy current analysis described above.

Having thus described the invention it is claimed:

1. A method for non-destructively determining satisfactory cooling of a ferrous workpiece after said workpiece has been heated above its critical temperature comprising the steps of:

(i) rapidly cooling said workpiece from said critical temperature to a lesser temperature which is approximately equal to greater than the $M_s$ temperature of said workpiece;

(ii) during the time said workpiece is cooling, periodically inducing eddy currents in said workpiece so that a plurality of eddy current pulses are produced in said workpiece during the time said workpiece is cooled;

(iii) periodically measuring said eddy currents produced in said workpiece at time intervals correlated with each eddy current pulse to produce a plurality of output signals correlated to the varying temperature of said workpiece as said workpiece is cooled;

(iv) generating a plurality of comparison signals, each comparison signal correlated to a different temperature ranging from the critical temperature to a temperature approximately equal to the $M_s$ temperature of said workpiece with a discrete time interval associated therewith and all comparison signals correlated to the critical cooling rate of said workpiece, said critical cooling rate being determined from the time-temperature-transformation diagram for said workpiece;

(v) comparing said output signals with said comparison signals on both a temperature and a temperature-time basis and rejecting or accepting said workpiece depending on the deviation between said signals.

2. The method of claim 1 further including the steps of providing a coil adjacent said workpiece and applying a high frequency current to said coil for a first fixed period of time to induce said eddy current in said workpiece immediately followed by a second fixed time period where said high frequency current is not applied to said coil, said first fixed time period when said high frequency current is applied to said coil being no longer than said second fixed time period during which said high frequency is not applied to the coil and repeating the on-off application of high frequency current to said coil throughout the time said workpiece is cooled.

3. The method of claim 1 further including the steps of providing a coil adjacent said workpiece, applying a first high frequency current to said coil for a first fixed time period followed by a second fixed time period during which no current is applied to said coil to induce a first eddy current pulse in said workpiece, applying a second high frequency current different from said first high frequency current to said coil for a third fixed time period followed by a fourth fixed time period during which no current is applied to said coil to induce a second eddy current pulse in said workpiece, generating a plurality of first and second eddy current pulses in said workpiece during the time said workpiece is cooled to produce a plurality of first and second output signals correlated to the temperature of said workpiece at different depths thereof.

4. The method of claim 3 wherein said first fixed time period is less than said second fixed time period and said third fixed time period is less than said fourth fixed time period.

5. The method of claim 1 wherein said workpiece has had a portion thereof heated to said critical temperature by induction heating and is immediatly cooled after being heated.

6. Apparatus for non-destructively determining the satisfactory heat treatment of a ferrous workpiece comprising:

(a) means for heating said workpiece to its critical temperature;

(b) means for rapidly cooling said workpiece from its critical temperature to a temperature approximately equal to or greater than the $M_s$ temperature of said workpiece;

(c) a coil adjacent said workpiece and situated within said cooling means;

(d) means for applying a high frequency current to said coil for a first fixed time period followed by a second fixed time period where no current is applied during the entire time said workpiece is cooling to induce a plurality of eddy current pulses throughout the time said workpiece is being cooled;

(e) means for measuring said eddy current pulses at periodic time intervals while said workpiece is being cooled to produce a plurality of output signals;

(f) microprocessor means for comparing each of said output signals with comparison signals previously stored in said microprocessor means and correlated to preferred temperature-time characteristics of said workpiece;

(g) output means associated with said microprocessor means for indicating the deviation of said output signals with said comparison signals and, accordingly, reject or accept said workpiece.

7. The apparatus of claim 6 wherein said means for heating comprises an induction heater.

8. The apparatus of claim 6 wherein said high frequency current applying means further includes means for applying a second high frequency current for a third fixed time period followed by a fourth fixed time period where no current is applied to said coil to produce a plurality of second eddy current pulses throughout the time said workpiece is being cooled, said high frequency current applying means further including means for applying said first and second high frequencies to said coil at regular, repeated intervals relative to one another, and fixed time periods where no current is applied and said microprocessor means further includes means for generating comparison signals corresponding to said first and second frequencies and correlated to preferred time-temperature characteristics of said workpiece at different depths thereof.

9. The apparatus of claim 6 wherein said controller means further includes means for controlling the time at which said high frequency current is applied to said coil to be shorter than the time at which said high frequency current is not applied to said coil.

* * * * *